United States Patent [19]

Garret

[11] Patent Number: 4,840,376

[45] Date of Patent: Jun. 20, 1989

[54] POKER AND POOL APPARATUS

[75] Inventor: Michael J. Garret, Delta, Canada

[73] Assignee: Cardball International Limited, Delta, Canada

[21] Appl. No.: 123,867

[22] Filed: Nov. 23, 1987

[30] Foreign Application Priority Data

Nov. 21, 1986 [CA] Canada ..... 523605

[51] Int. Cl.[4] ..... A63D 15/00; A63D 15/20

[52] U.S. Cl. ..... 273/14; 273/DIG. 26; 273/59 R; 273/2; 340/323 R

[58] Field of Search ..... 273/2, 12, 14, 59 R, 273/85 CP, 108, 115, 121 A, 123 A, 124 A, 125 A, DIG. 26, 1 ES; 364/410, 411; 340/323 R; 116/222; 377/5; 40/464, 446

[56] References Cited

U.S. PATENT DOCUMENTS

| | | | |
|---|---|---|---|
| 269,896 | 1/1883 | Swanton | 116/222 |
| 580,253 | 4/1897 | Clarke | 273/59 R |
| 3,958,804 | 5/1976 | Godfrey | 273/6 |
| 4,002,339 | 1/1977 | Reiner et al. | 273/123 A |
| 4,516,770 | 5/1985 | Brookes et al. | 273/11 R |
| 4,524,969 | 6/1985 | Erzmoneit | 273/3 R |

FOREIGN PATENT DOCUMENTS

| | | | |
|---|---|---|---|
| 0159763 | 10/1985 | European Pat. Off. | 273/2 |
| 3003376 | 8/1981 | Fed. Rep. of Germany | 364/411 |
| 3215364 | 10/1983 | Fed. Rep. of Germany | 273/2 |
| 2592808 | 7/1987 | France | 273/1 ES |
| 2166056 | 4/1986 | United Kingdom | 273/1 ES |

*Primary Examiner*—Leo P. Picard
*Assistant Examiner*—Jessica J. Harrison
*Attorney, Agent, or Firm*—John R. Uren

[57] ABSTRACT

A poker game used with a pool table. A plurality of balls, each ball marked with the face and suit of a card, corresponds to representations of the cards on a wall mounted scoreboard, the scoreboard carrying the same card markings for each player. A pushbutton under each card is manually operable to light up an individual indicated card when the corresponding ball is sunk on the pool table. A micro-processor is operable to determine the highest scoring "hand" of each player.

11 Claims, 5 Drawing Sheets

POKER AND POOL APPARATUS

INTRODUCTION

This invention relates to a poker game and, more particularly, to the playing of poker using a pool table of any size.

BACKGROUND OF THE INVENTION

Poker is a game which has been played and enjoyed for many years in many different variations. Pool is likewise played and enjoyed. In recent years, however, the number of variations in both games has become substantially exhausted with the result that the popularity of both games has declined. In respect of pool, substantial investments may have been made in expensive tables, cues, balls and the like which investments are not now productive. A novel approach to the playing of pool would therefore be desirable and a combination of pool and poker would appear to be attractive.

SUMMARY OF THE INVENTION

According to one aspect of the invention, there is disclosed a pool table game comprising a rectangular pool table having six pockets, one pocket being located at each corner of said table and two pockets being located on opposite sides of the longest sides of said table midway between said corner pockets, a plurality of balls, each of said balls being marked to indicate a separate and particular card of a deck, a scoreboard operable to be mounted separate from said pool table, said scoreboard indicating each of said cards corresponding with the card marking on a respective ball, and a pluralily of switches on said scoreboard, one for each of said cards and mounted adjacent thereto, each of said switches being manually operable to indicate which of said cards corresponds to a ball operable to enter one of said pockets.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
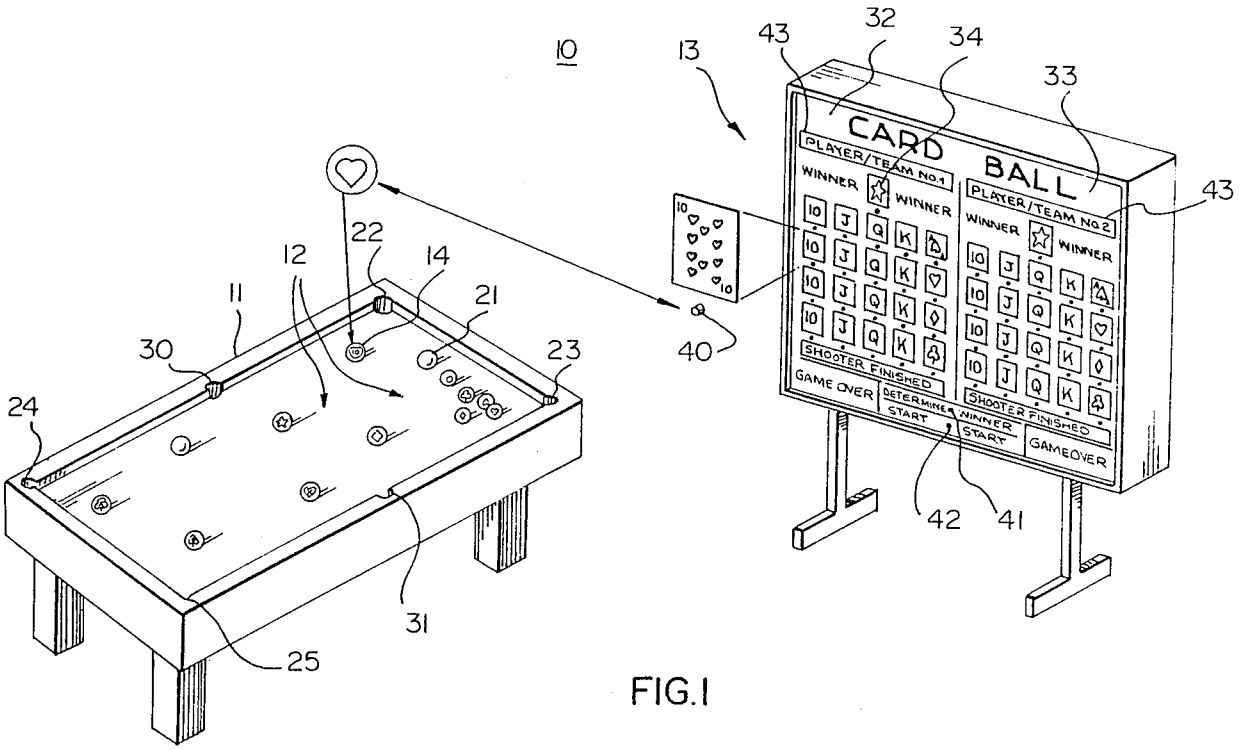
FIG. 1 is a diagrammatic isometric view of the apparatus according to the invention.
Figure 2:
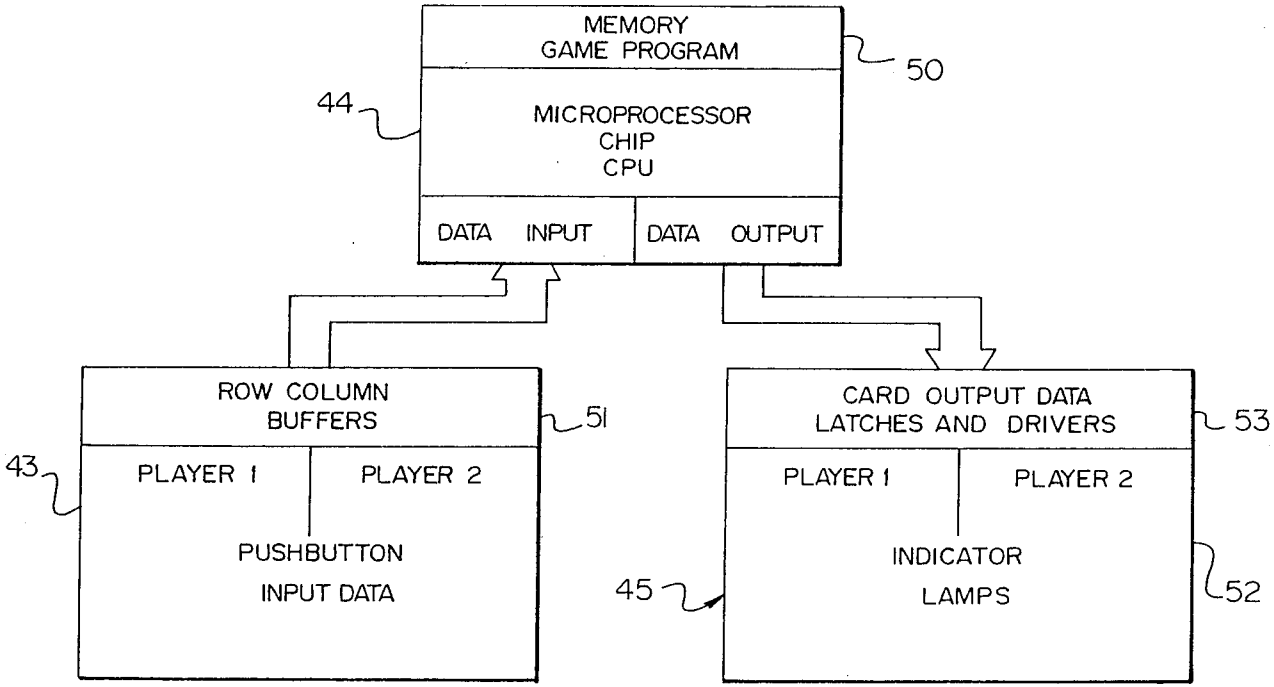
FIG. 2 is a simplified block diagram of the logic circuitry used to evaluate the highest score according to the invention.

A poker-pool game known popularly as CARD BALL (Trademark) is illustrated generally at 10 in FIG. 1. It comprises a pool table 11, a plurality of balls generally shown at 12 and a score board generally illustrated at 13.

The pool table 11 is a standard type pool table with six (6) Pockets located around the table 11. There are four corner pockets 22, 23, 24, 25 and two oppositely located side pockets 30, 31 located midway between the centre pockets on the longest sides of the table 11.

Twenty-two (22) balls are used for the CARD BALL game. Each ball is marked to represent one card; that is, each of 10, J, Q, K and A in one of four card suits, namely hearts, diamonds, spades or clubs. Ball 14, for example, is marked to represent the ten of hearts and so on. One additional ball 20 is the joker and a cue ball 21 is provided which is used, of course, to direct the card marked balls 12 into appropriate pockets on the pool table 11.

A score board 13 is positioned to be located independently and separate from the pool table 11. It is divided generally into two sections 32, 33, one section being used for each player or team. Each section has the individual cards presented thereon. That is, the 10, J, Q, K and A of each suit are displayed together with the joker 34.

Under and adjacent to each displayed card on the scoreboard 13, a switch in the form of a pushbutton 40 is provided. Pushbutton 40 is used to illuminate the card under which the individual pushbutton is located. The pushbutton 40, when manually operated, also indicates to the logic circuit used for determining the highest hand what card has been illuminated, the logic circuit being described below. One further button 41 is used to initiate operation of the logic circuit and an additional pushbutton 42 is used to empty the logic circuit and shut off the illumination of the various cards in order to commence another game.

The circuit logic for determining the highest hand held by the individual players is illustrated in FIGS. 2–5. It comprises a data input section 43 (FIG. 2), a central processor 44 and a data output section generally shown at 45.

All activity is controlled by the central processor 44. The particular action taken at any time is determined by the contents of memory 50 and the status of the row/column pushbutton input buffers 51 which run from the pushbutton 40 on the scoreboard 13. Action taken by the central processing section 44 includes lighting up one or more of the indicator lamps 52 by way of the output data latches and drivers 53.

Figure 4:
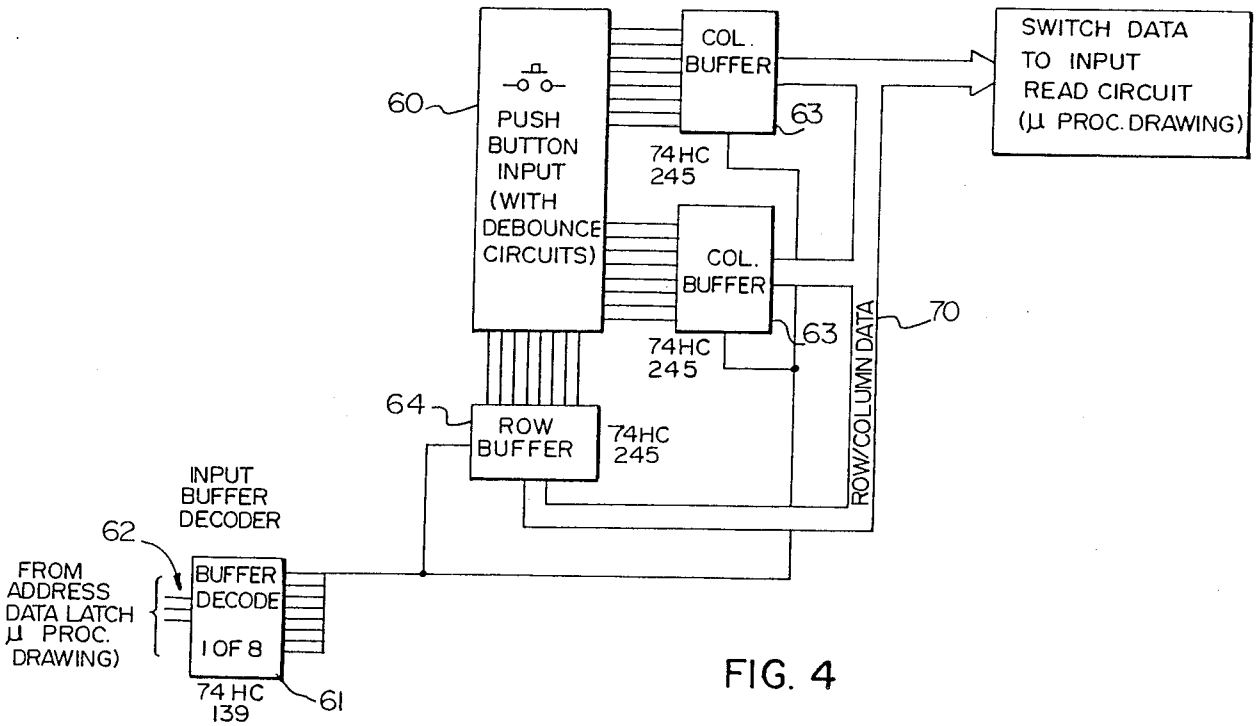
FIG. 4 is a further detailed circuit diagram of the data input section of the logic circuitry.

Referring to FIG. 4, three (3) address lines 62 originating the processor section 44 are utilized to determine which, if any, of the pushbuttons 40 in the pushbutton array 60 are depressed. This is accomplished by way of an input buffer decoder 61 which responds only to specific bit patterns on the three line address bus 62. Depressing a pushbutton in the array 60 causes a particular bit to be set in the column buffer 63 corresponding to the column in which the pushbutton 40 is situated. Likewise, the same action causes a particular bit to be set in the row buffer 64 corresponding to the row in which the pushbutton 40 is located. Data containing the row/column information is then placed on the data bus 70 for analysis and action by the central processor section 44.

Figure 5:
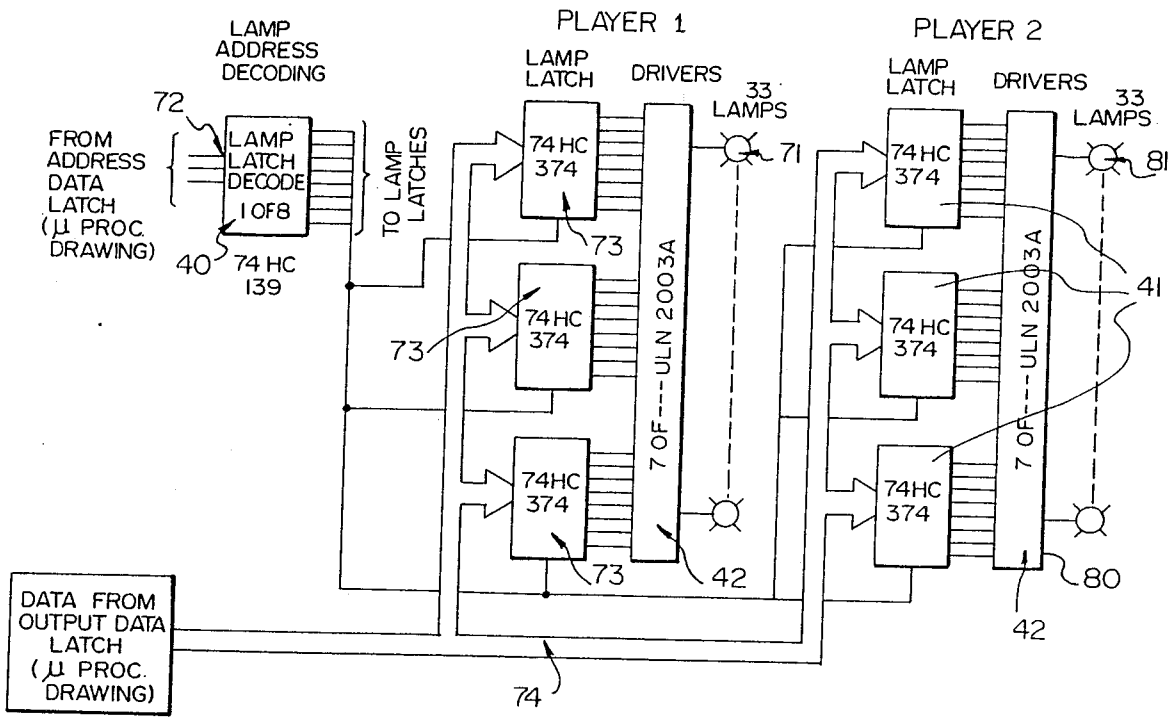
FIG. 5 is a detailed circuit diagram of the data output section of the logic circuitry.

Referring to FIG. 5, a similar system is used to select and light the selected lamp in the lamp array 71. Three address lines 72 from the central processor section 44 are used to enable the lamp latches 73. Data from the central processor is present on the data bus 74 and the bit pattern of that data sets or resets the output of the lamp latches 73. This, depending on the specific data, causes a lamp driver 80 and a corresponding lamp 81 to go on or off accordingly.

The pushbutton array 60 is coordinated with the lamp array 71 such that each pushbutton 40 is directly below and associated with a particular lamp. Each pushbutton/lamp combination is, in addition, labeled with a card name (e.g., ten of hearts). Additional lamps and buttons not associated with playing cards are also present for announcing the winner and signalling "game over".

Figure 3:
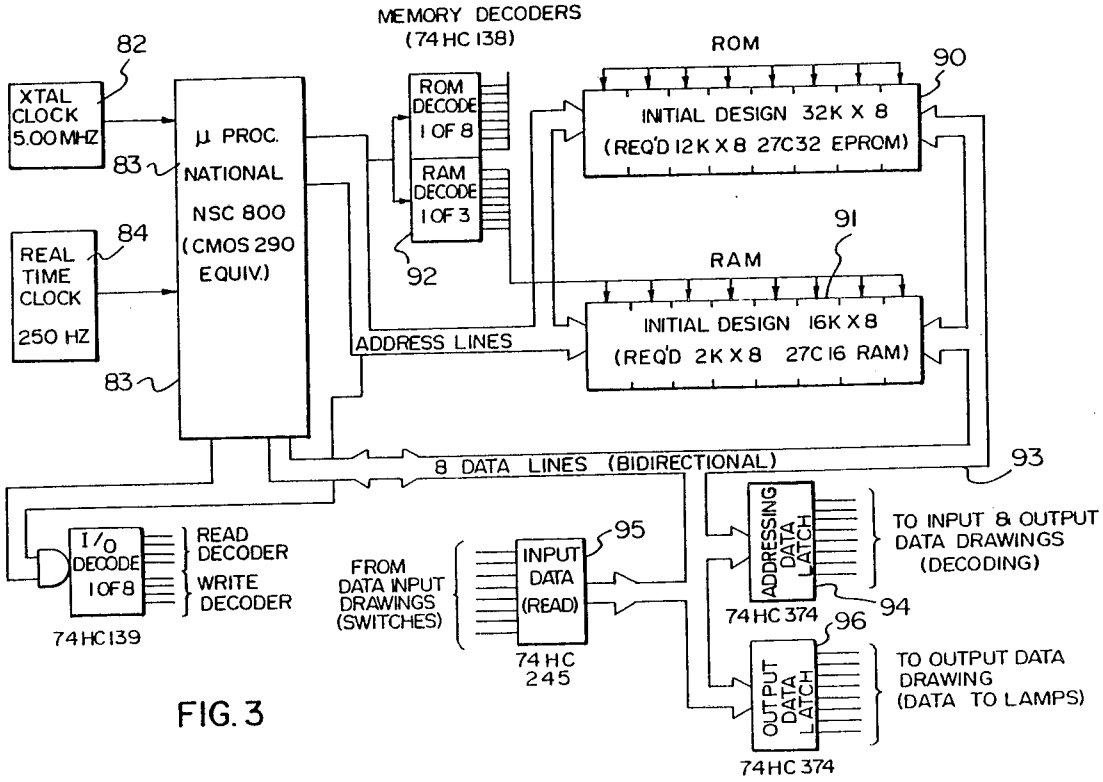
FIG. 3 is a detailed circuit diagram of the central processing section of the logic circuitry.

Referring to FIG. 3, the master clock 82 provides the necessary timing signals required by the microprocessor 83. A real time clock 84 is used to keep track of elapsed time independant from the microprocessor 83.

The control program is stored in non-volatile ROM 90 and the RAM 91 is utilized to record the values of the balls pocketed by each player. The design of the microprocessor 83 and the configuration of the address decoder 92 is such that the microprocessor 83 begins execution of a program located in a specific memory location in ROM 90 upon activation. The central processor 44 examines the status of the pushbutton array 60 and waits for a pushbutton 40 to be pushed. During play of the game, when a particular ball is sunk, the player responsible presses the pushbutton 40 on the appropriate side of the scoreboard 13 (e.g., PLAYER/TEAM NO. 1 or PLAYER/TEAM NO. 2) which corresponds to the ball sunk (e.g., ten of hearts). The central processor 44 (FIG. 2) performs a READ operation of the pushbutton array 60 (FIG. 4) by placing a specific command on the data bus 93 (FIG. 3) which is stored temporarily in the addressing data latch 94. The output of the latch 94 then goes to the three line address bus 62 (FIG. 4) of the data input section 60. Data concerning pushbutton status is returned to the microprocessor 83 (FIG. 3) by way of the input data buffer 95 and the data bus 93. Upon determining which pushbutton 40 has been depressed the central processor 44 then stores the value and suit of the ball sunk into a section of RAM 91 assigned to that player.

The central processor 44 then performs a WRITE operation to the output section by placing a specific command on the data bus 93 (FIG. 3) which is stored temporarily in the addressing data latch 94. The processor then causes the correct lamp in the array to light by placing a second command on the data bus 93 which is stored temporarily in the output data latch 96.

This process continues until the game is complete. Scoring is performed by the central processor 44 through an analysis of the contents of the memory sections assigned to the respective players.

Each ball is assigned a binary numeric value, the bit pattern of which corresponds to the suit and face value marked on the ball. As there are a finite number of possible scores, the central processor 44 searches the memory assigned to each player for particular bit patterns corresponding to a particular winning combination beginning with the highest possible hand (e.g., five aces) and working down hand by hand for the entire binary array. When this has been done the player with the highest score is declared the winner by lighting the WINNER lamp on the appropriate section of the scoreboard 13 and the GAME OVER lamp on both sides of the scoreboard 13 by the same method as earlier described. In the event the highest hand (e.g., five aces) is obtained, there is no search and that hand is immediately indicated on the scoreboard.

OPERATION

When it is desired to play a game of CARD BALL, the players push button 42 (FIG. 1) on the scoreboard 13 to clear the logic circuit and to turn off the illuminated card panels on the scoreboard 13. The card marked balls 12 are cued up with a triangle (not shown) as is usual when commencing a game of snooker, eight ball or pool.

It is then the object to sink nine (9) desired balls by each player. The balls 12, of course, are intended to build a good hand as indicated on the scoreboard 13 or, alternatively, to frustrate the opponents intention to build a good hand. Once a ball enters a pocket, it is removed from play. The shooting by each player will alternate but another shot is given when a ball other than the cue ball is pocketed. The players may, if desired, call the shots.

As each ball 12 enters a pocket of the pool table 11, the proper pushbutton 40 is pushed on the scoreboard 13 under the card corresponding to the ball which is pocketed. After a player sinks nine (9) balls, he is finished shooting and nine cards on his section of the scoreboard 13 will be illuminated. The other player, if he has not yet sunk nine (9) balls, will shoot until that number of balls is pocketed or he fails to pocket a ball twice in accordance with the rules.

The cards are, of course, displayed and experienced players may readily tell whether the highest five cards of a player constitute the winning hand. In such event, the logic circuit described will not be used. In the event, however, it is desired to automatically tally the highest hand, pushbutton 41 on scoreboard 13 is pressed and the operation of the logic circuit earlier described is initiated to automatically determine the highest hand. This is evidenced by a flashing panel 43 on the appropriate player or team side of the scoreboard 13. Following this determination, pushbutton 42 is pressed to intitate another game and play recommences as set out above.

Many modifications may be made to the apparatus described. For example, while the electronic and logic circuitry and components described have been found to be appropriate, it is evident that any other suitable logic circuits for determining the highest hand could also be utilized. In addition, while the specific embodiment contemplates a poker game being played, it is clear that any other games which utilize a deck of cards could also be played on the pool table and represented on the scoreboard 13. All that is required, in such event, is a new set of appropriately card marked balls and an amended scoreboard appearance, which appearance cold be provided by an appropriate overlay for the scoreboard 13. In a further development, logic can be provided to indicate on the scoreboard when a specific ball, such as a wild card or joker, is sunk.

Various other changes may be made to the invention by those skilled in the art and the specific embodiments described herein should be taken as illustrative only and not as limiting the scope of the invention as construed in accordance with the accompanying claims.

I claim:

1. A poker type pool game operable to be played on a standard rectangular pool table having six pockets, one pocket being located at each corner of said table and two pockets being located on opposite sides of the longest sides of said table midway between said corner pockets, said game comprising a plurality of balls, each of said balls being marked to indicate a separate and particular card of a deck, a scoreboard operable to be mounted separate from said pool table, said scoreboard indicating each of said cards corresponding with the card marking on a respective ball, and a plurality of switches on said scoreboard, one for each of said cards and each being mounted adjacent a respective card marking, each of said switches being manually operable to indicate which of said cards corresponds to a corresponding ball which enters one of said pockets.

2. A poker type pool game as in claim 1 wherein said poker type pool game is intended to represent poker.

3. A poker type pool game as in claim 2 wherein said scoreboard is divided into a plurality of substantially similar sections, each of said sections representing the balls entering a pocket which are played by an individual one of a plurality of players.

4. A poker type pool game as in claim 3 wherein said scoreboard is divided into two sections and two players or teams participate, one for each section.

5. A poker type pool game comprising a plurality of balls, each of said balls being marked to indicate a separate and particular card of a deck, a scoreboard operable to be mounted separate from a pool table, said scoreboard indicating each of said cards corresponding with the card marking on a respective ball, and a plurality of switches on said scoreboard one for each of said cards and mounted adjacent thereto, each of said switches being manually operable to indicate which of said cards corresponds to a ball operable to enter a pool table pocket.

6. A poker type pool game as in claim 5 wherein said game is intended to represent poker.

7. A poker type pool game as in claim 5 wherein said scoreboard is divided into a plurality of substantially similar sections, each of said sections representing the balls entering a pocket which are played by an individual one of a plurality of players.

8. A poker type pool game as in claim 7 wherein said scoreboard is divided into two sections and tow players or teams participate, one for each section.

9. A poker type pool game as in claim 8 wherein said scoreboard further includes logic circuit means operable from said switches, said logic circuit means being operable to indicate the highest score.

10. A poker type pool game as in claim 5 wherein said plurality of balls numbers twenty-one (21).

11. A poker type pool game as in claim 10 and further comprising a cue ball.

* * * * *